US008678250B2

(12) United States Patent
Williams

(10) Patent No.: US 8,678,250 B2
(45) Date of Patent: Mar. 25, 2014

(54) GARMENT HANGING DEVICE WITH SUPPORT MECHANISM

(76) Inventor: Ryan Williams, San Diego, CA (US)

( * ) Notice: Subject to any disclaimer, the term of this patent is extended or adjusted under 35 U.S.C. 154(b) by 576 days.

(21) Appl. No.: 12/464,052

(22) Filed: May 11, 2009

(65) Prior Publication Data

US 2010/0282787 A1 Nov. 11, 2010

(51) Int. Cl.
*A41D 27/22* (2006.01)

(52) U.S. Cl.
USPC ..... 223/85; 223/71; 223/92

(58) Field of Classification Search
USPC ..... 223/85, 87, 88, 92, 71, 98
See application file for complete search history.

(56) References Cited

U.S. PATENT DOCUMENTS

| | | | | | |
|---|---|---|---|---|---|
| 1,205,801 | A * | 11/1916 | Shapiro | ..... | 223/87 |
| 1,332,583 | A * | 3/1920 | Wakefield | ..... | 223/87 |
| 1,547,951 | A * | 7/1925 | Olson | ..... | 223/88 |
| 2,642,210 | A * | 6/1953 | Lang | ..... | 223/71 |
| 2,940,646 | A * | 6/1960 | Richa et al. | ..... | 223/71 |
| 2,967,647 | A * | 1/1961 | Billingsley | ..... | 223/71 |
| 3,098,590 | A * | 7/1963 | Richardson | ..... | 223/71 |
| 5,857,597 | A * | 1/1999 | Kolton | ..... | 223/85 |
| 2006/0037981 | A1 * | 2/2006 | Dedo | ..... | 223/87 |

FOREIGN PATENT DOCUMENTS

| | | | | | |
|---|---|---|---|---|---|
| GB | 2058001 | A * | 4/1981 | ..... | A47F 7/22 |

* cited by examiner

*Primary Examiner* — Nathan Durham
(74) *Attorney, Agent, or Firm* — Morrison & Foerster LLP

(57) ABSTRACT

An apparatus for hanging garments is disclosed. The apparatus includes a hanger device, and a substantially rigid support mechanism coupled to the hanger device. The support mechanism includes a slit extending through at least part of the support mechanism, and one or a plurality of button holes on at least one side of the slit, such that when a garment with one or a plurality of buttons is on the hanger device, a side of the garment with the one or a plurality of buttons extends through the slit so that at least one of the one or a plurality of buttons is inserted through at least one of the one or a plurality of button holes.

15 Claims, 5 Drawing Sheets

GARMENT HANGING DEVICE WITH SUPPORT MECHANISM

FIELD

The present invention relates generally to a hanger apparatus, and more particularly to a garment hanging device with a support mechanism.

BACKGROUND

Traditionally, garments (e.g., button-down dress shirts or a polo-style shirts) on a hanger are prone to wrinkling due to transporting the garments or hanging them on an overstuffed rack. For example, when transporting multiple garments in a car, there may be insufficient room to hang the garments. As a result, the garments are often placed on a seat or in the trunk, which can result in wrinkling. As another example, wrinkles may occur while carrying a hanging garment outside in windy conditions. Further, garments often fall off their hangers in a pile on the floor, or an entire hanger with the garment may fall off the rack, causing the garment to become wrinkled on the floor.

Therefore, there is a need, for people who transport clothing on hangers (e.g., dry cleaners) and those who hang clothes for a period of time, for a garment hanging device having a support mechanism for keeping the garment substantially straight at all times, thereby mitigating wrinkles.

SUMMARY

The presently disclosed embodiments are directed to solving one or more of the problems presented in the prior art, described above, as well as providing additional features that will become readily apparent by reference to the following detailed description when taken in conjunction with the accompanying drawings.

One embodiment of the present disclosure is directed to an apparatus for hanging garments. The apparatus includes a hanger device; and a support mechanism coupled to the hanger device. the support mechanism includes a slit extending through at least part of the support mechanism, and one or a plurality of button holes on at least one side of the slit, such that when a garment with one or a plurality of buttons is on the hanger device, a side of the garment with the one or a plurality of buttons extends through the slit so that at least one of the one or a plurality of buttons is inserted through at least one of the one or a plurality of button holes.

Another embodiment of the present disclosure is directed to method of hanging a garment. The method includes attaching a support mechanism to a hanger device, where the support mechanism includes a slit extending through at least part of the support mechanism, and one or a plurality of button holes on at least one side of the slit. The method further includes extending a side of the garment with the one or a plurality of buttons through the slit; and inserting at least one of the one or a plurality of buttons through at least one of the one or a plurality of button holes.

Yet another embodiment is directed to apparatus, including means for hanging a garment; and means for supporting the garment. The means for supporting the garment includes a slit extending through at least part of the means for supporting the garment, and one or a plurality of button holes on at least one side of the slit, such that when a garment with one or a plurality of buttons is on the means for hanging the garment, a side of the garment with the one or a plurality of buttons extends through the slit so that at least one of the one or a plurality of buttons is inserted through at least one of the one or a plurality of button holes.

Further features and advantages of the present disclosure, as well as the structure and operation of various embodiments of the present disclosure, are described in detail below with reference to the accompanying drawings.

BRIEF DESCRIPTION OF THE DRAWINGS

The present disclosure, in accordance with one or more various embodiments, is described in detail with reference to the following Figures. The drawings are provided for purposes of illustration only and merely depict exemplary embodiments of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

FIG. 1(*b*) is an illustration of a support mechanism attachable to a hanger device, according to an embodiment.

DETAILED DESCRIPTION OF EXEMPLARY EMBODIMENTS

Figure 1A:
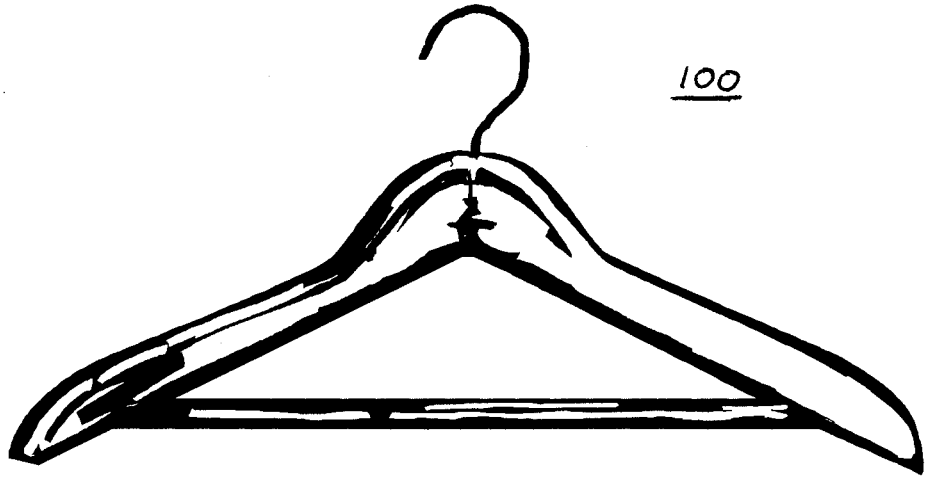
FIG. 1(*a*) is an illustration of a hanger device according to an embodiment of the present disclosure.

The following description is presented to enable a person of ordinary skill in the art to make and use embodiments of the invention. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of this disclosure. Thus, the present disclosure is not intended to be limited to the examples described herein and shown in the drawings, but is to be accorded the scope consistent with the claims.

The word "exemplary" is used herein to mean "serving as an example or illustration." Any aspect or design described herein as "exemplary" is not necessarily to be construed as preferred or advantageous over other aspects or designs.

Reference will now be made in detail to aspects of the subject technology, examples of which are illustrated in the accompanying drawings, wherein like reference numerals refer to like elements throughout.

It should be understood that the specific order or hierarchy of steps in the processes disclosed herein is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

Figure 1B:
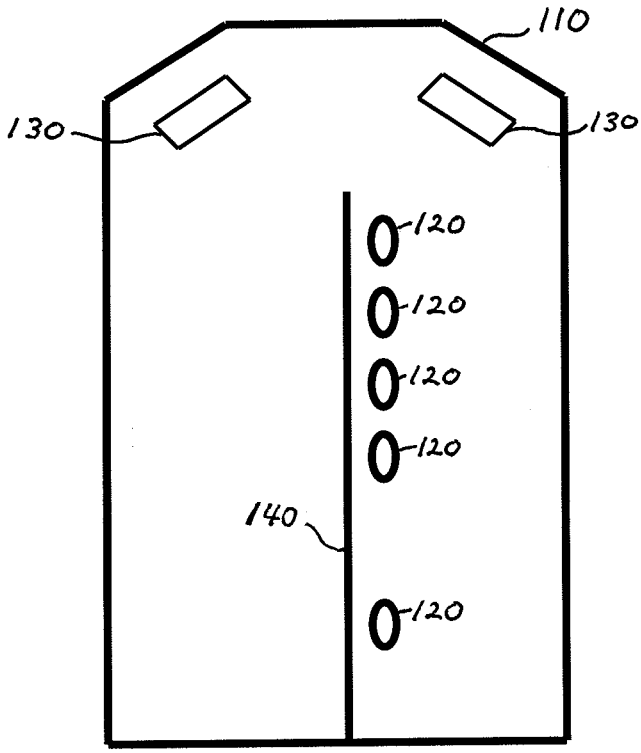

FIG. 1(*a*) is an illustration of a hanger device according to an embodiment of the present disclosure. As shown in FIG. 1(*a*) a hanger device 100 may be any conventional garment hanger, and one of ordinary skill in the art would realize that various types of hanger devices 100 may be used within the scope of the present disclosure. For example, hanger device 100 may be formed of various materials, such as plastic, metal and/or wood. Hanger device 100 may include any additional hooking devices or clips for holding a plurality of garments concurrently (e.g., pants and/or a shirt). A standard hanging device 100 is depicted for exemplary purposes, but is not intended to limit the disclosure in any way. A typical hanger device 100, for example, may be approximately 16 inches wide and approximately 9 inches tall. However, any size hanger device 100 may be employed within the scope of the present disclosure.

FIG. 1(*b*) is an illustration of a support mechanism attachable to a hanger device, according to an embodiment. A support mechanism 110 may be formed of any substantially rigid material (e.g., polycarbonate plastic). Various materials may be used, depending on the rigidity desired to support the garment to be hung. A thin plastic material may be used for most shirts, for example, thereby providing sufficient rigidity without overly burdensome weight or cost. Support mechanism 110 may be, for example, approximately 33 inches long and approximately 16 inches wide, thereby supporting most hangable garments. However, one skilled in the art would realize that various sizes of support mechanisms 110 may be employed, within the scope of the present disclosure, depending on the garment to be hung.

Support mechanism 110, according to the depicted embodiment, includes a slit 140, which may be substantially centered on support mechanism 110. However, slit 140 may alternatively be positioned further to either side of support mechanism 110. Slit 140 may extend for any distance along support mechanism 14. According to an exemplary embodiment, slit 140 may begin approximately 8.5 inches from the top of support mechanism 110, such that the buttons of a garment (described in greater detail below with reference to FIG. 3) begin near the top of slit 140. According to certain embodiments, slit 140 extends completely to the bottom of support mechanism 110, such that the two sides of support mechanism 110 (on each side of slit 140) are separable from each other.

Along one side of slit 140, one or a plurality of button holes 120 are positioned such that the buttons of a garment (described in greater detail below with reference to FIG. 3) substantially align with the button hole(s) 120. According to certain embodiments, button holes 120 may be spaced apart by approximately 3.5 inches, with the bottom button hole 120 approximately 6.25 inches from the next lowest button hole 120. These measurements generally provide proper alignment of buttons and the button holes 120, for a size 33½ or Large dress shirt, for example. However, any number and placement of button holes 120, dependent upon the button positions of a garment, within the scope of the present disclosure. Support mechanism 110 may also include one or more holding slits 130 used to attach support mechanism 110 to hanger device 100 (described in greater detail below with reference to FIG. 2).

In the depicted exemplary embodiment of FIG. 1(*b*), button holes 120 are along the right side of support mechanism 110, such that the button side of a man's dress shirt, for example, when placed over support mechanism 110, could be extended through slit 140 and the buttons would align under button holes 120 (described in greater detail below with reference to FIG. 3). However, button holes 120 may be on the left side (e.g., to align with buttons of a woman's blouse). For example, the support mechanism 110 could be flipped over, depending on the button position of any particular garment. Alternatively, support mechanism 110 may include button holes 120 on both sides of slit 140, to be useable regardless of which side of the garment the buttons reside.

Figure 2:
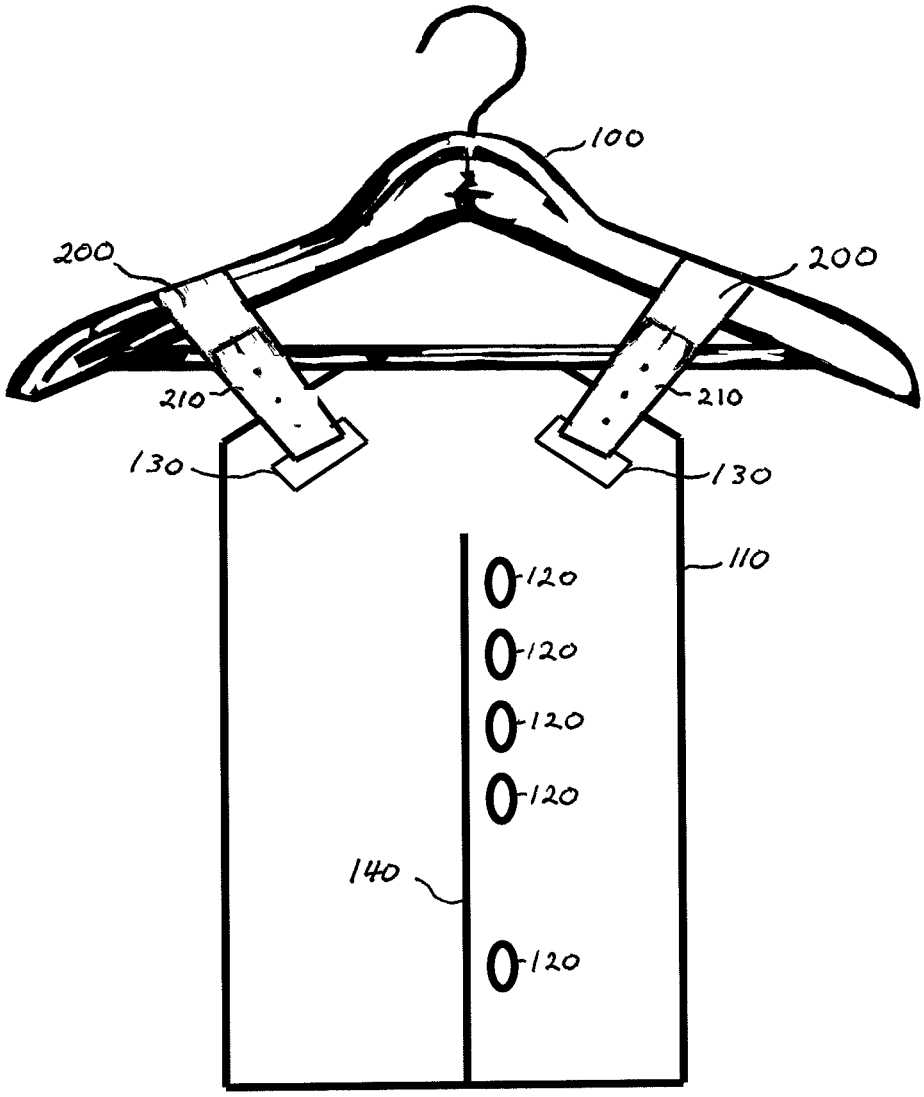
FIG. 2 is an illustration of a support mechanism attached to a hanger device using fastening straps, according to an embodiment.

FIG. 2 is an illustration of a support mechanism 110 attached to a hanger device 100 using fastening straps 200, according to an embodiment. Support mechanisms 110 may attached to hanger device 100 using fastening straps 200 looped through, or otherwise secured to, the at least one holding slit(s) 130. In the embodiment depicted in FIG. 2, fastening straps 200 include an adjustable notched section 210, so that the length of the fastening straps 200 can be changed in order to align the button holes 120 with the button (s) of a garment to hang. Fastening straps 200 may be formed of any material, such as plastic for example. Any type of adjustable-length fastening mechanism may be implemented, according to various embodiments. In the embodiment depicted in FIG. 2, fastening straps 200 are secured to the top, angled portion of hanger device 100 for exemplary purposes; however, one of skill in the art would realize that fastening straps 200 may be attached to any part of hanger device 100. Of course, fastening strap(s) 200 may be any type of hooking device for coupling support mechanism 110 to hanger device 100. The exemplary embodiment of FIG. 2 is merely one way to couple support mechanism 110 to a preexisting hanger device 100, and is not intended to limit the present invention in any way.

Figure 3:
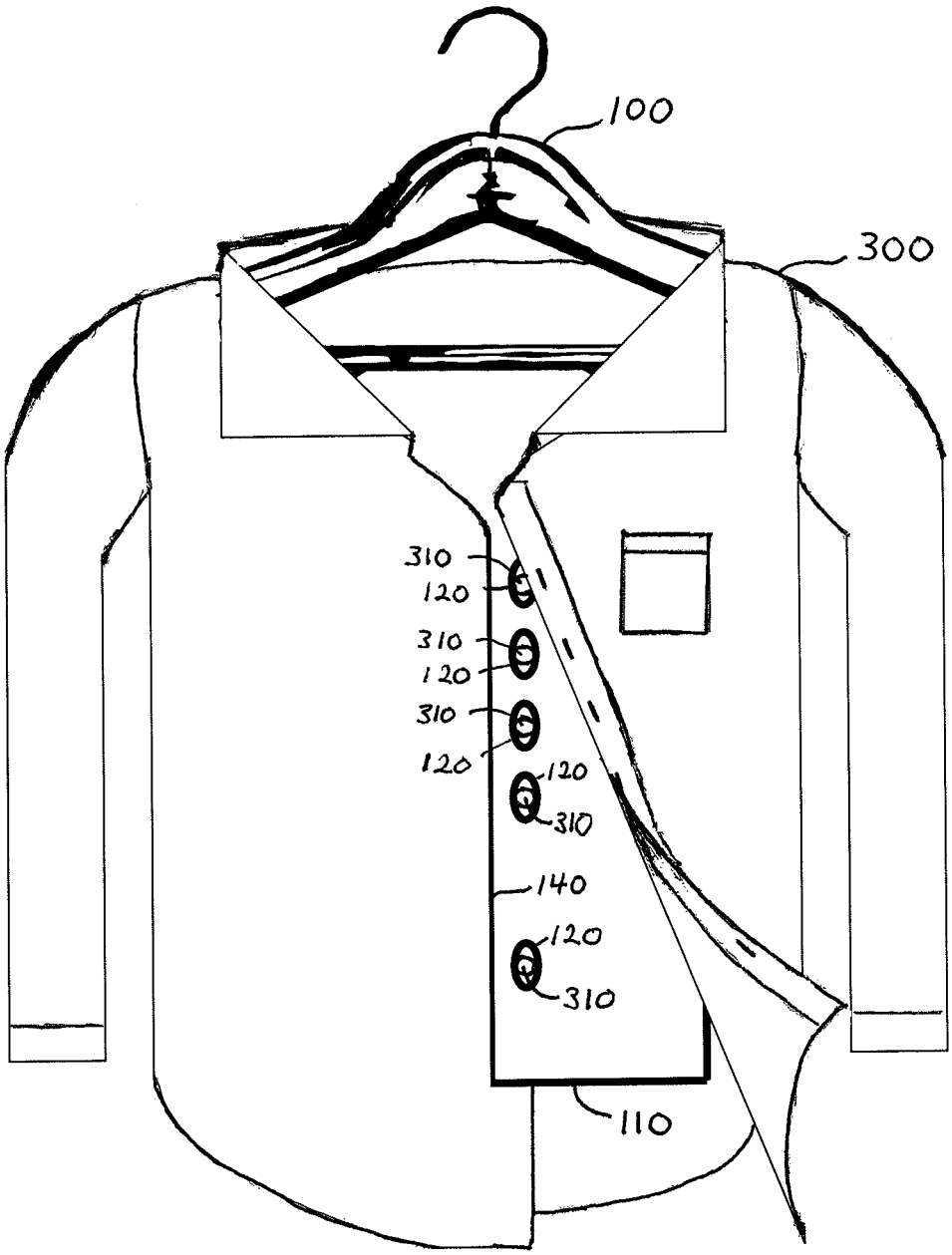
FIG. 3 is an illustrating of a garment hanging on a hanger device with an attached support mechanism, according to an embodiment.

FIG. 3 is an illustration of a garment 300 hanging on a hanger device 100 with an attached support mechanism 110, according to an embodiment. The garment 300 of the embodiment depicted in FIG. 3 is a dress shirt; however, various types of garments 300, such as a polo shirt, a jacket or coat, or a uniform may be similarly hung. As shown in FIG. 3, support mechanism 110 is attached to hanger device 100 such that the button holes 120 are aligned with the buttons 310 of garment 300. When hanging on hanger device 100, the side of garment 300 including buttons 310 may be pushed through slit 140 of support mechanism 110 so that buttons 310 are aligned with button holes 120. One or more of the buttons 310 may then be pushed through one or more corresponding button holes 120, thereby fastening garment 300 to support mechanism 110. Thereafter, one or more of the buttons 310 may be pushed through one or more of the button holes of garment 300, to even more securely attach garment 300 to support mechanism 110.

Figure 4:
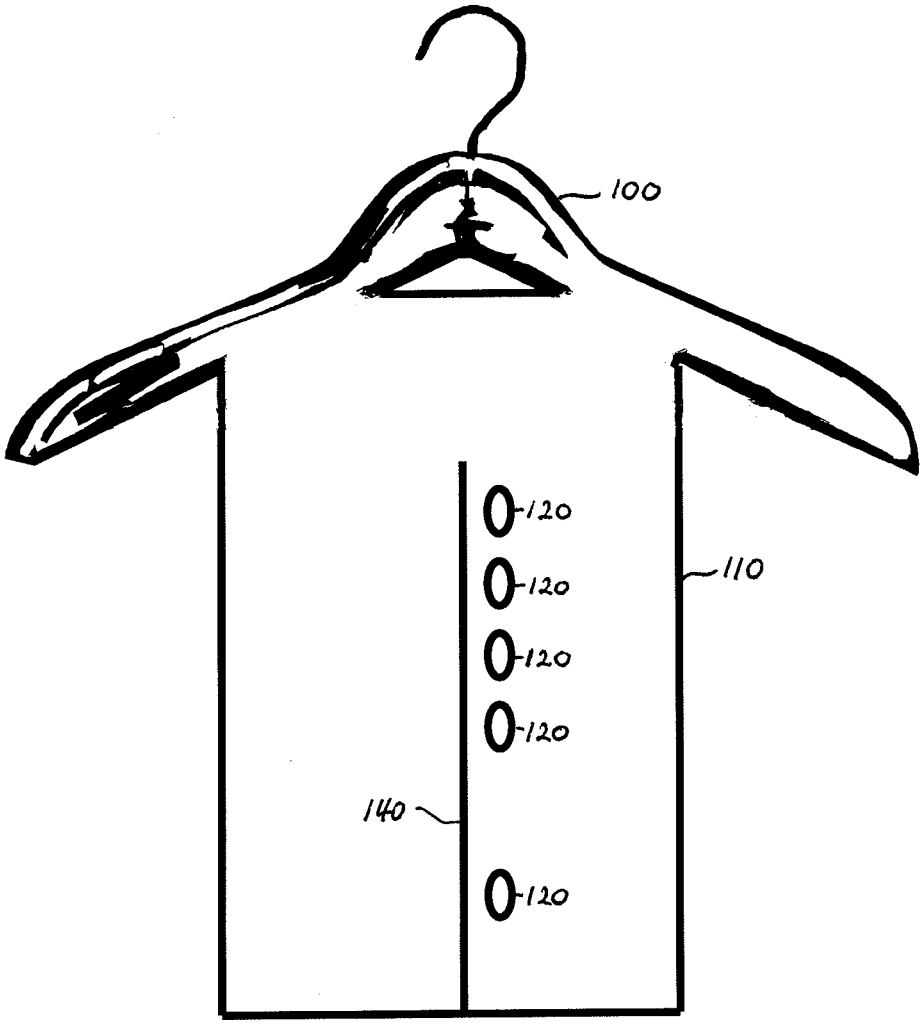
FIG. 4 is an illustration of a hanger device and a support mechanism formed as a single unit, according to an embodiment.

FIG. 4 is a hanger device 100 and a support mechanism 110 formed as a single unit, according to an embodiment. Hanger device 100 and support mechanism 110 may be manufactured as a single unit, such that holding slits 130 and fastening straps 200 would be unnecessary. Of course, the embodiment depicted in FIG. 4 is merely one example of a single unit, and one of ordinary skill would realize that there are various ways to form a single unit comprising hanger device 100 and support mechanism 110.

Figure 5:
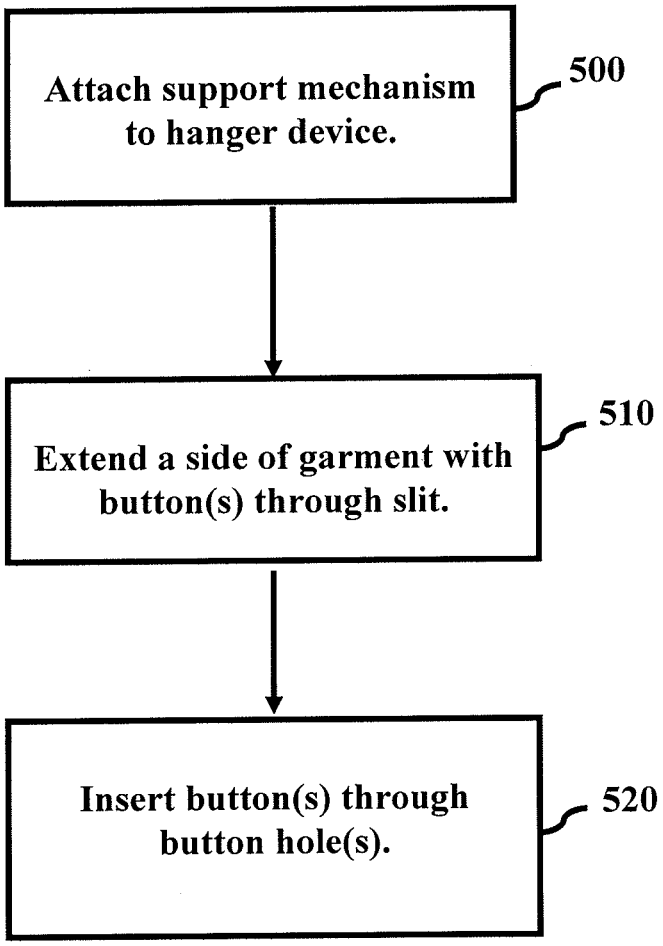
FIG. 5 is a flowchart illustrating a method of hanging a garment, according to an embodiment.

FIG. 5 is a flowchart illustrating a method of hanging a garment 300, according to an embodiment. Referring to FIG. 5, at operation 500 support mechanism 110 is coupled to hanger device 100. As noted previously, support mechanism 110 may be fastened to hanger device 100 using adjustable fastening straps 200, for example. Alternatively, support mechanism 110 and hanger device 100 may be formed as a single unit, as shown in FIG. 4. As previously described, support mechanism 110 may include slit 140 extending through at least part of the support mechanism 110, and one or a plurality of button holes 120 on one side of the slit 140.

From operation 500, the process continues to operation 510, where a side of the garment 300 with the one or a plurality of buttons 310 is extended through the slit 140. Support mechanism 110 may be adjusted such that button holes 120 are aligned with the one or a plurality of buttons 310 of garment 300. Thereafter, at operation 520, at least one of the one or a plurality of buttons 310 is/are inserted through at least one of the one or a plurality of button holes 120, thus securing garment 300 to support mechanism 110. Of course, buttons 310 may be further pushed through the button hole(s) of garment 300 for added security.

Accordingly, embodiments of the present disclosure provide a garment hanging device having a support mechanism for keeping the garment substantially straight at all times, thereby mitigating wrinkles. Implementing an apparatus and method for hanging garments, as described herein, one can transport clothing on hangers (e.g., dry cleaning) and hang clothes for a period of time without worrying about the clothes becoming wrinkled due to laying on a seat or falling to the floor, for example. Further, garments can stay straight and flat while hanging on an overstuffed rack, compressed by other garments.

While various embodiments of the invention have been described above, it should be understood that they have been presented by way of example only, and not by way of limitation. Likewise, the various diagrams may depict an example architectural or other configuration for the disclosure, which is done to aid in understanding the features and functionality that can be included in the disclosure. The disclosure is not restricted to the illustrated example architectures or configurations, but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to", or other like phrases in some instances shall not be read to mean that the narrower case is intended or required in instances where such broadening phrases may be absent.

Furthermore, although individually listed, a plurality of means, elements or method steps may be implemented by, for example, a single unit or processing logic element. Additionally, although individual features may be included in different claims, these may possibly be advantageously combined. The inclusion in different claims does not imply that a combination of features is not feasible and/or advantageous. Also, the inclusion of a feature in one category of claims does not imply a limitation to this category, but rather the feature may be equally applicable to other claim categories, as appropriate.

What is claimed is:

1. An apparatus for hanging a garment, comprising:
a hanger device; and
a reinforcing mechanism coupled to the hanger device, wherein the reinforcing mechanism includes:
a slit of at least 3.5 inches and extending through at least part of the reinforcing mechanism,
at least one holding slit, such that one or more fastening straps are looped through the at least one holding slit and fastened to the hanger device, and
one or a plurality of button holes on at least one side of the slit, such that when the garment, with one or a plurality of buttons is substantially wrapped around and supported by the hanger device, fabric of a side of the garment with the one or a plurality of buttons extends through the slit so that at least one of the one or a plurality of buttons is inserted through at least one of the one or a plurality of button holes.

2. The apparatus of claim 1, wherein the one or more fastening straps are adjustable in length.

3. The apparatus of claim 1, wherein the hanger device and the reinforcing mechanism are formed as a single unit.

4. The apparatus of claim 1, wherein the one or a plurality of button holes includes a plurality of button holes, the plurality of button holes being vertically separated by approximately 3.5 inches.

5. The apparatus of claim 1, wherein the one or a plurality of button holes includes a plurality of button holes, a lowest of the plurality of button holes being approximately 6.25 inches below a next lowest button hole.

6. A method of hanging a garment, comprising:
attaching a reinforcing mechanism to a hanger device, wherein the reinforcing mechanism includes:
a slit of at least 3.5 inches and extending through at least part of the reinforcing mechanism;
at least one holding slit, such that one or more fastening straps are looped through the at least one holding slit and fastened to the hanger device; and
one or a plurality of button holes on at least one side of the slit;
extending fabric of a side of the garment, substantially wrapped around and supported by the hanger device, with the one or a plurality of buttons through the slit; and
inserting at least one of the one or a plurality of buttons through at least one of the one or a plurality of button holes.

7. The method of claim 6, wherein the one or more fastening straps are adjustable in length.

8. The method of claim 6, wherein the hanger device and the reinforcing mechanism are formed as a single unit.

9. The method of claim 6, wherein the one or a plurality of button holes includes a plurality of button holes, the plurality of button holes being vertically separated by approximately 3.5 inches.

10. The method of claim 6, wherein the one or a plurality of button holes includes a plurality of button holes, a lowest of the plurality of button holes being approximately 6.25 inches below a next lowest button hole.

11. An apparatus, comprising:

means for hanging a garment; and means for reinforcing the garment, wherein the means for reinforcing the garment includes:

a slit of at least 3.5 inches and extending through at least part of the means for reinforcing the garment, at least one holding slit, such that one or more fastening straps are looped through the at least one holding slit and fastened to the means for hanging the garment, and one or a plurality of button holes on at least one side of the slit, such that when the garment, with one or a plurality of buttons, is substantially wrapped around and supported by the means for hanging the garment, fabric of a side of the garment with the one or a plurality of buttons extends through the slit so that at least one of the one or a plurality of buttons is inserted through at least one of the one or a plurality of button holes.

12. The apparatus of claim 11, wherein the one or more fastening straps are adjustable in length.

13. The apparatus of claim 11, wherein the means for hanging the garment and the means for reinforcing the garment are formed as a single unit.

14. The apparatus of claim 11, wherein the one or a plurality of button holes includes a plurality of button holes, the plurality of button holes being vertically separated by approximately 3.5 inches.

15. The apparatus of claim 11, wherein the one or a plurality of button holes includes a plurality of button holes, a lowest of the plurality of button holes being approximately 6.25 inches below a next lowest button hole.

* * * * *